United States Patent [19]

Chu et al.

[11] 4,047,947

[45] * Sept. 13, 1977

[54] PROCESS FOR PREPARATION OF TRANSPARENCIES BY SELECTIVE DECOMPOSITION OF AN ORGANOSELENIUM COMPOUND IN A POLYMERIC MATRIX

[75] Inventors: Joseph Y. C. Chu, Fairport; Wolfgang H. H. Gunther, Webster, both of N.Y.

[73] Assignee: Xerox Corporation, Stamford, Conn.

[ * ] Notice: The portion of the term of this patent subsequent to Nov. 30, 1993, has been disclaimed.

[21] Appl. No.: 517,120

[22] Filed: Oct. 23, 1974

[51] Int. Cl.[2] ..... G03G 5/12; G03G 13/24; G03C 1/00

[52] U.S. Cl. ..... 96/1.3; 96/1 PE; 96/88

[58] Field of Search ..... 96/1 PE, 1.3, 88, 1.5

[56] References Cited

U.S. PATENT DOCUMENTS

| | | | |
|---|---|---|---|
| 3,671,467 | 7/1972 | Gunther | 96/1 |
| 3,738,831 | 7/1973 | Gunther | 96/1.5 |
| 3,900,590 | 8/1975 | Dhoble | 427/22 |

FOREIGN PATENT DOCUMENTS 1,294,136 10/1972 United Kingdom

OTHER PUBLICATIONS

Polymer Hdbook, Brandrup & Immergut, Intersci. Publ., © 1966, sec. III, pp. 70–73.

N.Y. Acad. of Sci. (vol. 192) NMR Studies: Lardon Apr. 17, 1972, pp. 132–147.

*Primary Examiner*—Mary F. Kelley

*Assistant Examiner*—Louis Falasco

*Attorney, Agent, or Firm*—James J. Ralabate; James P. O'Sullivan; John H. Faro

[57] ABSTRACT

Process for preparation of transparencies from a solid phase dispersion of photoconductive particles in an insulating binder matrix. In this process, a dispersion is initially formed from an insulating polymer resin and an organoselenium compound capable of undergoing selective decomposition in response to an appropriate stimulus, whereby elemental selenium is extruded from said organoselenium compound and deposited within the polymeric resin. As a result of this deposition of elemental selenium within the insulating layer, the layer is rendered photoresponsive and can be used in conventional electrophotographic processes. Subsequent to the development and fusion of a developer image on this imaging member, the extrusion/deposition reaction can be reversed and the selenium deposit erased thus leaving a toner image fused to a substantially transparent polymeric film.

15 Claims, No Drawings

PROCESS FOR PREPARATION OF TRANSPARENCIES BY SELECTIVE DECOMPOSITION OF AN ORGANOSELENIUM COMPOUND IN A POLYMERIC MATRIX

BACKGROUND OF THE INVENTION

1. Field of the Invention

This invention relates to a process and an aritcle prepared according to this process. More specifically, this invention involves a process for preparation of transparencies.

2. Description of the Prior Art

The methods for recording of image information on photosensitive materials are many and varied. Generally, in such systems, image information is projected onto a photosensitive medium and the medium either visually or invisibly (chemically or electrically) altered. In order to develop such invisible alteration of the photosensitive medium, the altered and/or unaltered areas of the photosensitive medium are brought in contact with an additional material or agency which facilitates the manifestation of such differences either in the form of a change in color and/or a change in optical density or both. In classical silver halide photography, image formation results from the irreversible chemical reduction of a silver salt in the exposed areas of the photographic emulsion and the selective removal of the unreduced silver from the emulsion. Depending upon the particular photographic emulsion and developing process, the image can be recorded either positively or negatively on the photosensitive medium.

More recently, there has been disclosed a migration imaging system wherein photosensitive or non-photosensitive particles are selectively caused to migrate from (or just below) the surface of a softenable material into the bulk of said material in response to image information, U.S. Pat. Nos. 3,556,781 and 3,653,885. In a typical embodiment of such a migration imaging system, a migration imaging member which consists essentially of a layer of softenable or soluble material containing migration material coated on a conductive substrate is prepared and an electrostatic latent image is formed on the surface of this softenable layer. The softenable layer is then developed by heating or by contacting said layer with a solent or vapors of a solvent which attacks only the softenable layer. A portion of the migration material will migrate through this softenable layer during development and in certain instances deposit in imagewise configuration on the conductive substrate. Those particles which do not migrate to the conductive substrate can be removed along with the softenable layer through the use of solvents. The imaging members used in such migration imaging processes can have three distinct structures: a layered configuration, which comprises a conductive substrate, a layer of softenable material and an overcoating of migration material (usually particulate) embedded in the upper surface of the softenable layer; a binder structure in which the migration material is dispersed throughout the softenable layer; and, thirdly, an overcoated structure in which the conductive substrate is overcoated with a layer of softenable material followed by a layer of migration material and a second overcoating of softenable material, thus sandwiching the migration material therebetween. Where the non-imaged portion of the migration materials are not removed, the resultant image appears against a background of such materials.

It has been suggested that such background may be reduced by simply heating of the image member, U.S. Pat. No. 3,556,781 — column 3, lines 49–53.

In still yet another imaging system, a precursor (an "organo-metallo" compound) is initially dispersed in an amorphous glass matrix and chalcogens selectively extruded therefrom in response to (a) exposure of said layer to imagining energy followed by a second exposure to development energy; (b) simultaneous exposure of the dispersion to both imaging and development energy; or (c) simply exposure of the dispersion to imaging energy; German Patent Application OLS No. 2,233,868 (priority being claimed to U.S. patent application Ser. No. 163,891 now abandoned filed July 19, 1971). The glassy matrix within which such chalcogen deposition cakes place, must be capable of trapping intermediate compounds, radicals and charge carriers generated during exposure to imaging energy in order to enable subsequent thermal development and/or enhancement of the desired chalcogen deposit. Chalcogen formation is manifest within this glassy matrix by the appearance of a permanent, dense, highly visible deposit conforming to the image input. Unfortunately, the above system is not readily capable of fixation, that is, inadvertent exposure of the imaged film to additional stimuli can result in the unwanted deposition of additional chalogen materials and thuscan seriously impair or destroy the previously formed image pattern.

As is evident from the above discussion, it is generally necessary to either remove or modify the background portions of the imaged member in order to enhance image contrast. In a typical silver halide photographic system, this is achieved by chemical means. In the migration imaging systems, image background is reduced by removal of the non-migrated materials or by thermal modification thereof, subsequent to development. In each instance, the imaged member is irrevisibly modified and cannot be further imaged by exposure to additional image information. Although the imaging system described in the above referenced German publication does possess the capability of having further image information added onto the previously imaged dispersion, such a capability is in fact a serious limitation on both the use and storage of the product of this imaging system.

It is thus apparent that although it would be desirable to have an imaging member capable of producing high resolution images in response to image information without the necessity of separate development and fixation of the image pattern, the systems presently available for achieving such results are seriously deficient with regard to their ability to be rendered further insensitive to image input in order to avoid inadvertent and undesirable alteration of the previously formed image pattern.

Accordingly, it is the object of this invention to remove the above as well as related deficiencies in the prior art.

More specifically, it is the principal object of this invention to provide a process for preparation of transparencies which can be modified by the exposure thereof to additional image information.

it is an additional object of this invention to provide an imaging process for preparation of transparencies which does not require the use of liquid chemicals or solvent vapors in either the development or the fixation of the image pattern within the transparency.

It is yet an additional object of this invention to provide a process for the preparation of transparencies which can prevent the inadvertent recording of image information on the transparency and yet retain the ability of the transparency for recording additional image information.

Further objects of this invention include the preparation of transparencies by the above process.

SUMMARY OF THE INVENTION

The above and related objects are achieved by providing a process for the preparation of a solid phase dispersion comprising selenium particles in an insulating polymeric matrix. In this process, an organo-selenium compound of the formula $$R - (Se)_n - R_1$$

wherein:

R and $R_1$ are independently selected from the group consisting of benzyl, alkyl substituted benzyl, alkoxy substituted benzyl, acyl substituted benzyl, amino substituted benzyl, amido substituted benzyl, arylalkyl substituted benzyl, aryl substituted benzyl, alkoxy alkyl substituted benzyl, aryloxy alkyl substituted benzyl, amino alkyl substituted benzyl, hydroxy alkyl substituted benzyl, alkyl amino substituted benzyl, aryl amino substituted benzyl, alkyl carbonyl substituted benzyl, alkyl thio substitued benzyl, alkyl seleno substituted benzyl, carboxamido substituted benzyl, halogen substituted benzyl, carboxyl substituted benzyl, cyano substituted benzyl, and nitro substituted benzyl;

*n* is 1 to 4;

is initially combined with a film forming polymeric material in an appropriate solvent vehicle and the resulting dispersion and/or solution formed into a solid film either on or independent of a supportive substrate. The organo-selenium compounds of this dispersion are capable upon selective exposure to electromagnetic radiation (at the appropriate wavelength), of undergoing substantial carbon-selenium bond scission whereupon elemental selenium is extruded from said compound and deposited within the bulk of the resulting film in substantial conformity with the distribution of electromagnetic radiation throughout said film. The photoconductive deposit thus produced can be used in the formation of an electrostatic latent image. The latent image which is formed on such a film can be developed with conventional electrophotographic developer materials and the developed image affixed thereto by standard solvent or thermal fusion techniques. As an incident to thermal fixation of the developed image to the polymeric film, the selenium extrusion/deposition reaction can be reversed, thus substantially depleting the polymeric film of elemental selenium. In the event that the image is fixed by other than thermal fusion techniques, the film will require an additional heating step for reversal of the extrusion/deposition reaction. The imaged structure produced in the manner described above, cannot be readily distorted by the inadvertent exposure of the film to additional imaging energies. Where it is desirable to add on additional information to the exposed film, the selenium deposit can be regenerated and the entire process of latent image formation and development repeated. After such additional information is added onto the image film, the selenium deposit may again be erased by simply heating the film sufficiently to cause reversal of the extrusion/deposition reaction.

DESCRIPTION OF THE INVENTION INCLUDING PREFERRED EMBODIMENTS

The source of elemental selenium used in the process of this invention can be selected from a limited number of materials which are capable of undergoing a decomposition reaction in response to an appropriate stimulus (preferably ultraviolet light), thereby yielding as one of products of such decomposition elemental selenium. The products of such decomposition reaction must also be capable of recombining so as to substantially deplete the polymeric film of the elemental selenium upon exposure to yet another energy source (e.g. thermal energy). The by-products of these reactions must be compatible with electrophotographic imaging and must not themselves, or in combination with other materials in the film, form products which are incapable of recombining with the selenium upon subjecting said layer to an appropriate stimulus. The organo-selenium compounds which have proven themselves highly suitable for use in the process of this invention include organo-selenides of the formula $$R - (Se)_n - R_1$$

wherein:

R and $R_1$ are independently selected from the group consisting of benzyl, alkyl substituted benzyl, alkoxy substituted benzyl, acyl substituted benzyl, amino substituted benzyl, amido substituted benzyl, arylalkyl substituted benzyl, aryl substituted benzyl, alkoxy alkyl substituted benzyl, aryloxy alkyl substituted benzyl, amino alkyl substituted benzyl, hydroxy alkyl substituted benzyl, alkyl amino substituted benzyl, aryl amino substituted benzyl, alkyl carbonyl substituted benzyl, alkyl thio substituted benzyl, alkyl seleno substituted benzyl, carboxamido substituted benzyl, halogen substituted benzyl, carboxyl substituted benzyl, cyano substituted benzyl, and nitro substituted benzyl;

*n* is 1 to 4.

Many of the compounds within the scope of the above formula are readily available from commercial sources and where not so available can be prepared by methods disclosed in the technical literature; see *Organic Selenium Compounds: Their Chemistry and Biology*, D. L. Klayman and W. H. H. Günther, Eds., Wiley-Interscience Publications, John Wiley & Sons, Inc., New York, 1973.

The film forming polymeric materials used in combination with one or more of the above organo-selenium compounds in formation of the solid phase dispersions used in the process of this invention can be virtually any thermoplastic resin or elastomer which is both chemically compatible with one or more of the previously described organo-selenium compounds and is capable of transmitting the energy necessary for initiation of the extrusion/deposition of elemental selenium from the above selenium compounds. Especially preferred polymeric materials which can be used in such solid phase dispersions include those polymers capable of transport of charge carriers generated during photoexcitation of elemental selenium and the other products of the decomposition reaction. Representatives of such preferred polymeric materials include polymers of N-vinyl carbazole and vinylpyrene. Other polymers which can form dispersions with organo-selenium compounds, but yet are substantially incapable of transport of charge carriers generated during photoexcitation of selenium, are also suitable for use in the process of this invention. Representative of such electronically "inert" polymers include polystyrene, poly(alkyl acrylates), poly (alkyl methacrylates), cyanoethyl starch, cyanoethyl cellulose, cellulose acetates, poly(vinyl formal), poly(vinyl acetal), poly (vinyl butyl), poly(butadiene), poly(dimethylsiloxane), poly(esters), their respective blends and copolymers.

In preparation of the solid phase dispersion useful in the process of this invention, it is generally preferable to first dissolve the organo-selenium compounds and the polymeric materials in a common solvent. The resulting solution is then cast, sprayed, draw or dip coated on a supportive, preferably conductive, substrate. The relative weight ratio of organo-selenium compound to polymeric materials in the coating solution can range from about 10:90 to about 90:10 and preferably from about 20:80 to about 30:70. The amount of solution transferred to the supportive substrate can be sufficient to form a coating having a dry film thickness in the range of from about 0.1 to about 10 mils. Any of the substrates traditionally used in combination with photoconductive insulating layers in electrophotographic imaging members can be used in the process of this invention as a supportive member. Typical of such substrates are aluminum, chromium, nickel, metallized plastic films, metal coated plastic films, conductive cellulosic materials and metal oxide coated glass plates (e.g. NESA glass). Supportive substrates which are especially suitable for use in the process of this invention are both flexible and transmissive of energy used in the extrusion/deposition of elemental selenium from the organo-selenium compounds contained within th polymeric dispersion.

Alternatively, the organo-selenium compounds described previously may be dispersed within a preformed, crosslinked polymeric film simply by swelling the latter in an appropriate solvent also containing one or more of the previously defined organo-selenium compounds. Upon evaporation of the solvent, the organo-selenium compounds remain entrapped within the polymeric film as a fine molecular dispersion. Such crosslinked polymer films have distinct and superior physical properties (e.g. abrasion resistance) when compared with films prepared from conventional linear polymers. For example, highly crosslinked films are less soluble in many organic solvents, thus, permitting greater latitutde in the casting or coating of additional layers thereon. Moreover, the more highly integrated network of such films precludes both moisture from penetrating into its bulk and the possible extraction of essential materials contained within these films; as may often occur during liquid development and/or subsequent cleaning of the surface of such films with solvents.

Once having formed a polymeric dispersion of organo-selenium compounds on/in a supportive substrate in a manner described above, the dispersion is allowed to dry until substantially free of solvent residues used in its preparation. This dispersion containing the organo-selenium compounds can then be subjected to a source of energy (thermal or electromagnetic radiation) of sufficient magnitude so as to be capable of effecting decomposition of such compounds and thereby the extrusion and deposition of elemental selenium within the matrix of the polymeric film. The manner of transmission and the type of energy employed to effect such decomposition reaction should not be sufficient to effect any substantial adverse alteration in the polymeric materials present within this dispersion. The source of such energy can be electromagnetic radiation and/or thermal energy. In a typical embodiment of this invention, a polymeric dispersion prepared as described above is irradiated with sufficient ultraviolet light to cause uniform extrusion of elemental selenium just below in surface of the irradiated film. The distribution of selenium in this film can vary with the extent of distribution and depth of penetration of the extrusion energy into this film. For example, during uniform ultraviolet light illumination of a film containing a solid phase dispersion of an organo-selenium compound, most of the incident radiation will be absorbed at or slightly below the surface of the film disposed proximate to the energy source. Upon absorption of this energy, selenium is extruded and deposited is substantial conformity therewith just below the surface of the film. As this deposition proceeds, the optical density of the film increases, thus, precluding penetration of the extrusion energy into the more remote depths of the film. Where the film thickness is substantially in excess of the depth of penetration of substantial amounts of extrusion energy, the cycling efficiency of resulting member will preclude its repeated use in a rapidly cycling electrostatographic imaging mode due to inefficient photodischarge unless the polymeric matrix or some other material contained within the film provides the necessary carrier transport across that portion of the film which is substantially devoid of elemental selenium. Inefficient or poor transport of charge carriers by the matrix of the dispersion during electrostatographic imaging does not, however, prevent acceptable latent image formation. Quite the contrary, the relative efficiency of charge carrier transport by the polymeric matrix containing the dispersed organo-selenium compounds has little, if any, discernible effect upon the ability of the dispersion to selectively photodischarge (to the extent necessary) to generate a contrast potential capable of development with both dry and liquid developers. Thus, a film of this dispersion can have a thickness which is relatively independent of both carrier range and mobility. Film thicknesses, which are suitable for use in this invention, can, therefore, range from as low as 0.1 microns to about 10 mils; the film thickness ultimately selected primarily being determined by factors unrelated to selenium extrusion and electrostatographic imaging.

After having initially subjected the solid phase dispersion to activating electromagnetic radiation, it is possible to further alter the physical form and quantity of the deposited selenium within the polymeric matrix merely by the application of heat at a predetermined temperature for an interval which is determined by the type and degree of alteration desired. For example, when an essentially uniform layer of amorphous selenium is heated either uniformly or selectively, the effected portions of the selenium deposit located just below the surface of the polymeric film can be caused to agglomerate into small compact spherical amorphous particles; such contraction or agglomeration occurring at the level formerly occupied by the amorphous layer. Further heating to higher temperatures can cause the breakup of these particles into smaller particles and their more extensive distribution throughout the polymeric film. Prolonged heating of this dispersion results in essentially a reversal of the decomposition reaction and, thus, a reduction in the concentration of elemental selenium within the polymeric film. Reversal of the decomposition reaction will result in a reconstitution of the original organo-selenium compounds or the formation of analogous compounds. The compounds formed by this erasure of the selenium deposit are generally capable of undergoing repeated carbon-selenium bond scission in the same manner as the original precursor compound and thus the reusable nature of the dispersion is preserved even though the selenium precursor compound can now differ from the one initially incorporated into the insulating polymer matrix. Where such selenium is deposited along with or in the presence of other chalcogens (e.g. tellurium) and/or other metal ions, these elements may combine with the selenium and thereby render subsequent erasure considerably more difficult or impossible.

Since the decomposition of the selenium precursor compound can be performed selectively in response to a localized stimulus, it is possible to prepare a photoconductive pattern of elemental selenium within the polymeric matrix merely by projecting a pattern of extrusion energy onto the polymeric film containing the precursor compound. This photoconductive pattern can be in the form of regularly spaced dots or have a screen-type arrangement. Space dot photoconductors are known to be suitable for use in preparation of half-tone reproductions and the screen-type photoconductors are known to be suitable for use in enhancing solid density development and extending the dynamic range of the photoresponsive element.

After having prepared a solid phase dispersion suitable for use in electrophotographic imaging, the surface of the dispersion can be sensitized in the dark in the conventional manner by charging with a corona electrode followed by selective exposure to image input at a wavelength sufficient to cause photoexcitation of the selenium deposit, thereby resulting in latent image formation on the surface of the polymeric film. This latent image can be developed with any of the standard developer compositions traditionally used in electrophotographic imagining systems. Such developers can include pigmented thermoplastic particles or solutions and/or dispersions of pigmented particles. Following the development of the latent electrostatic image on the surface of the dispersion, the developed image can be firmly affixed to the surface of the dispersion by any of the conventional techniques traditionally used in electrophotographic imaging systems. In the preferred embodiments of this invention, the method for fixation of the developed image will also cause at least some reversal of the extrusion/deposition reaction and thereby at least partially deplete the polymeric film of elemental selenium. This depletion of the polymeric film of elemental selenium improves developed image contrast, insofar as the background of the image is rendered substantially colorless.

The Examples which follow further define, describe and illustrate the process of this invention. Apparatus and techniques used in preparation of the films of this process are standard or as hereinbefore described. Parts and percentages appearing in such Examples are by weight unless otherwise indicated.

EXAMPLE I

Preparation of Dibenzyl Diselenide

A prerequisite in preparation of dibenzyl diselenide is the preparation of bis(methoxy magnesium) diselenide reagent. This reagent is prepared by placing about 3 grams (0.125 moles) magnesium turnings in a 1 liter round bottom flask together with a small crystal of iodine. This mixture is heated over a gas flame until the magnesium is "activated". About 200 milliliters dry methanol is then introduced into the flask, the flask fitted with a reflux condenser and a magnetic stirrer. The contents of the flask are heated to boiling under reflux conditions, and after the yellow iodine color has been discharged, about 7.9 grams (0.1 moles) dry selenium powder introduced into the mixture. The mixture is stirred until the initial vigorous reaction ceases and all solids have gone into solution.

About 12.6 grams (0.1 moles) benzylchloride is now added by dropwise addition over a period of 15 minutes to the magnesium diselenide reagent. In about 5 to 10 minutes after the mixture of these materials, the reddish brown color of the solution appears discharged. This solution is diluted further by the addition of 200 milliliters water and the addition of 10 milliliters concentrated hydrochloric acid. Upon cooling of this solution, the solids contained within the flask are collected by filtration and recrystallized from ethanol. Yield: 14 grams of yellow crystals (m. p. 94° C). Infrared spectral analysis of this material confirms that it is dibenzyl diselenide.

A chloroform solution containing about 0.5 parts by weight dibenzyl diselenide (DBDS) and 3 parts by weight poly(N-vinylcarbazole)—("Luvican", molecular weight 205,000, commercially available from BASF-)—is coated on a NESA glass plate using conventional draw bar coating techniques. The equipment used in this coating procedure is a Gardner mechanical drive film coating apparatus which is equipped with an application bar having a wet gap setting of 0.008 inches. The coated NESA plate is placed in a hood for several hours and then transferred to a vacuum chamber where it remains overnight. Sufficient solution is transferred to the NESA plate to provide a coating having a dry film thickness of approximately 10 microns. Upon substantially complete removal of residual chloroform from the coating, the coating is uniformly irradiated with ultraviolet light from a distance of 6 inches for a period of 10 minutes. The source of ultraviolet irradiation is a water-cooled 450 watt Hanovia medium pressure mercury arc lamp. The coating on the NESA plate turns reddish orange indicating the presence of elemental selenium. The electrophotographic properties of the plate are now evaluated with a Xerox Model D processor. After charging this plate in the dark to a positive potential of about 600 volts, it is exposed to a light and shadow image by means of a Xerox No. 4 camera; exposure being for 12 seconds at f 16. The latent image thus produced is rendered visible by cascade development with a composition comprising Xerox 2400 Toner and 250 $\mu$ steel MTP carrier. The toner image is now fused to the surface of the polymeric coating by heating the coating to about 250° F for 30 seconds whereupon the selenium background of the toner image becomes substantially colorless.

EXAMPLES II-XI

The procedures of Example I are repeated except for variation in the relative concentration of dibenzyl diselenide to poly(N-vinylcarbazole), referred to in the following table as PVK. The table which follows indicates the effect that such variation in concentration can have upon the photodischarge characteristics of the solid phase dispersion.

| Example | Composition of Coating Solution DBDS wt. % | PVK wt. % | wt. % of DBDS in Photoreceptor | Toner Image |
|---|---|---|---|---|
| II | 1 | 4 | 20.0 | Good image, light background |
| III | 0.5 | 5 | 9.1 | Poor image |
| IV | 1 | 5 | 16.7 | Fair to good image, light background |
| V | 2 | 5 | 28.6 | Good image, no background |
| VI | 3 | 5 | 37.5 | Good image, moderate background |
| VII | 4 | 5 | 44.4 | DBDS crystallized out |
| VIII | 1 | 10 | 9.1 | No image |
| IX | 2 | 10 | 16.7 | Good image, no background |
| X | 3 | 10 | 23.1 | Good image, light background |
| XI | 1 | 3 | 25.0 | Good image, no background |

As is evident from the above data, at least about 16 weight percent of dibenzyl diselenide must be present in the polymeric matrix in order to effectively extrude and deposit sufficient elemental selenium to render the solid phase dispersion photoconductive. Where insufficient selenium is present in the solid phase dispersion, the photodischarge characteristics of the dispersion may be insufficient to effectively discharge the sensitizing surface charge and thus preclude effective formation of a latent electrostatic image pattern on the surface of the dispersion. Where the concentration of dibenzyl diselenide within the polymeric matrix is in excess of about 38 percent, it will readily crystallize and thus preclude the uniform photoextrusion of elemental selenium throughout the polymeric matrix.

EXAMPLE XII

A 25 milliliter solution contaning 3 grams dibenzyl diselenide and 10 grams of a copolymer of styrene and hexylmethacrylate (80:20 mole ratio, $\overline{M}n$ 41,300 and intrinsic viscosity in toluene at 25° C of 0.16) is applied to a series of brushed aluminum plates using a Gardener Mechanical Drive film coater having a wet gap setting of 1, 2, 4, and 8 mils respectively. Each of the four plates thus prepared is exposed for two minutes to an 8 watt low pressure mercury discharge lamp (Mineral Light 12 (Ultraviolet Products, Inc., San Gabriel, Calif.) with the filter removed from a distance of about 3 cm. The resulting densities of photoextruded selenium appears substantially identical in all four plates, indicating that the photochemical events are taking place at a depth not exceeding the layer thickness resulting from the narrowest gap setting. The above plates are further exposed to energy from a 450 watt medium pressure Hanovia mercury arc lamp through an appropriate band passed filter for the same period of time from the same distance. The optical density of the selenium deposit increased upon such second exposure to in excess of about 2.0. Each of the above plates is then heated to a temperature in the range of from about 60° to about 80° C for further intensification of the selenium deposition. After the plates have cooled to room temperature, they are individually charged with a positive corona to a surface potential of about 700 volts exposed to a test target using a Xerox Model A camera for 15 seconds at f 10.5. The resultant latent image is then toned with Xerox 2400 Toner. Gross photodischarge measurements using a non-contact electrometer indicates that substantially no charge decay occurred in the illuminated areas. Apparently, injection of the sensitizing charge from the surface of the selenium layer to the interface of the selenium layer and polymer is sufficient to provide sufficient contrast potential for creation of a latent image. This incomplete photodischarge of the plate does however, make the electrostatic transfer of unfused toner particles virtually impossible. Subsequent to toning of the latent image, the plate is heated sufficiently to cause the photoconductive film to soften. The electrostatic forces acting between the toner and the conductive backing apparently caused the toner to become deeply embedded within the polymeric matrix. The resultant image thus produced comprises distinct surface depressions within the photoconductive film. Continued heating of this layer results in a reversal of the photoextrusion/deposition reaction whereby the selenium recombines with dibenzyl monoselenide thus causing reduction in selenium density and improvement in image contrast.

EXAMPLE XIII

A chloroform solution (100 parts) containing one part by weight dibenzyl diselenide and three parts by weight poly(N-vinylcarbazole) is coated on a series of 2 mil thick aluminized Mylar films using a Gardener Mechanical Drive film applicator equipped with a doctor blade having a wet-gap setting of 2, 4, 6, and 8 mils respectively. Each of the coated films is dried in a vacuum oven and then subjected to UV radiation using a Rayonet Photochemical Reactor (Model RTR-208 equipped with RUL-3000°A units lamps (Southern New England UV Co., Middleton, Conn.) from a distance of 3 inches for a period of 15 to 20 minutes. Upon removal of the plates from the reactor, they are evaluated xerographically in the same manner described in Example 1. The images produced from these plates have very good resolution. Upon subsequent fusion of the toner to the plates, the selenium background becomes substantially clear.

EXAMPLE XIV

The procedures of Example XII are repeated except that a cyan color toner is substituted for the Xerox 2400 Toner. Fusion of the toner particles to the substrate and clearing of the selenium background is performed is substantially the same manner.

EXAMPLE XV

The procedures of Example XIII are repeated except for the use of a magenta toner.

EXAMPLE XVI

The procedures of Example XIII are repeated except that the toner is fused to the plates at the minimum temperature required to permanently affix the developed image (20 seconds at 120°C). This abbreviated fixing interval is insufficient to cause substantial depletion of selenium from the image and background areas of the film. The imaged member is now recharged and reimaged with a different target and toned with a magenta toner followed by fusion at 150° for approximately 60 seconds. The previously formed toner image does not photodischarge so the magenta toner is attracted to both the new image information and the previously formed toner image. Upon fusion of this toner to the plate, the second image appears magenta is color whereas the first image now appears brownish black.

EXAMPLE XVII

A series of electrophotographic plate are prepared in the manner described in Example XII except for the selective masking of the film of the solid phased dispersion prior to the photoextrusion of selenium therein. This selective masking is thereafter removed and the plate processed in the same manner described in Example XII. That area of the plate which was masked is incapable of discharge of the sensitizing charge and thus, toner particles are also attracted thereto during the development of the latent image pattern on the surface of the plate. The toner attracted to this formerly masked area provides a code or numbering systems by which the image can later be cataloged or identified.

EXAMPLE XVIII

A four micron thick film containing three parts by weight poly(N-vinylcarbazole) and one part by weight dibenzyl diselenide is prepared by draw bar coating a 25 weight percent chloroform solution of these materials on an aluminized Mylar substrate. The film is allowed to dry in a vacuum and thereafter subjected to ultraviolet radiation in a Rayonet photochemcial reactor in the same manner described in Example XIII. After removal of the film from the reactor, it is charged in the dark to a positive surface potential of about 200 volts and then exposed through a contact resolution target to actinic radiation (at approximately 4000 A for five seconds; total exposure approximately 3 ergs/cm$^2$). The latent image thus produced is developed in the dark with a negatively biased gravure roller laden with a liquid developer composition comprising a dispersion of carbon black and a dispersant in an oleaginous vehicle (e.g. Ligroin). Upon evaporation of the oleaginous vehicle, the developed film is heated at about 250° F for 3 seconds thereby resulting in clearing of the film background of the selenium deposit and, thus, substantially enhancing developed imaged contrast. The resolution of the developed image is estimated by microscopic examination at about 200 line pairs per millimeter.

What is claimed is:

1. A process for preparation of transparencies comprising:

a. forming a photoconductive solid phase dispersion of particles of selenium in an insulating polymer matrix by subjecting an insulating film consisting essentially of an organo-selenium compound and an insulating polymer to sufficient electromagnetic and/or thermal energy to effect decomposition of the organo-selenium compound whereby particles of selenium are deposited within the insulating film in substantial conformance with the distribution of the electromagnetic and/or thermal energy throughout the film, the organo-selenium compounds of this film being represented by the formula $$R - (Se)_n - R_1$$

wherein:

R and $R_1$ are independently selected from the group consisting of benzyl, alkyl substituted benzyl, alkoxy substituted benzyl, acyl substituted benzyl, amino substituted benzyl, amido substituted benzyl, arylalkyl substituted benzyl, aryl substituted benzyl, alkoxy alkyl substituted benzyl, aryloxy alkyl substituted benzyl, amino alkyl substituted benzyl, hydroxy alkyl substituted benzyl, alkyl amino substituted benzyl, aryl amino substituted benzyl, alkyl carbonyl substituted benzyl, alkyl thio substituted benzyl, alkyl seleno substituted benzyl, carboxamido substituted benzyl, halogen substituted benzyl, carboxyl substituted benzyl, cyano substituted benzyl, and nitro substituted benzyl; and $n$ is 1 to 4.

b. forming a latent electrostatic image on the surface of said insulating film;

c. developing the latent image by bringing said latent image in contact with oppositely charged developer materials; and d. affixing of the developer materials to the insulating polymeric film.

2. The process of claim 1, wherein the organo-selenium compound is dibenzyl diselenide.

3. The process of claim 1, wherein the insulating polymer matrix is a poly(vinylcarbazole).

4. The process of claim 1, wherein the insulating polymer matrix is poly(styrene-co-hexylmethacrylate).

5. The process of claim 1, wherein the developer materials comprises a carbon black pigmented thermoplastic resin.

6. The process of claim 1, wherein the developer materials comprise a liquid solution and/or dispersion of pigment.

7. The process of claim 1, wherein steps (a) —(d) are repeated in sequence at least one additional time.

8. The process of claim 7, wherein the developer materials used in each successive sequence are different in color from that used in each prior sequence.

9. The process of claim 1, wherein the insulating polymer film is selectively exposed to the decomposition effective stimulus.

10. The process of claim 9, wherein the selective exposure to a decomposition effective stimulus results in a pattern of regularly spaced dots of selenium particles being deposited within the polymeric matrix.

11. The process of claim 9, wherein the selective exposure to a decomposition effective stimulus results in a screen pattern of selenium particles being deposited within the polymeric matrix.

12. The process of claim 9, wherein the selective exposure to a decomposition effective stimulus results in a failure of deposition of selenium particles in the form of an encoding character along at least one of the borders of the film.

13. The process of claim 1 wherein step (d) comprises heating the insulating film sufficiently to cause both fixation of the developer materials to the insulating film and substantial depletion of particles selenium from the insulating polymer matrix.

14. The process of claim 1, wherein the developed image is affixed to the insulating film by heating.

15. A process for preparation of transparencies comprising:

a. forming a photoconductive solid phase dispersion of particles of selenium in an insulating polymer matrix by subjecting an insulating film consisting essentially of an organo-selenium compound and an insulating polymer to sufficient electromagnetic and/or thermal energy to effect decomposition of the organo-selenium compound whereby particles of selenium are deposited within the insulating film in substantial conformance with the distribution of the electromagnetic and/or thermal energy throughout the film, the organo-selenium compounds of this film being represented by the formula $$R - (Se)_n - R_1$$

wherein: R and $R_1$ are independently selected from the group consisting of benzyl, alkyl substituted benzyl, alkoxy substituted benzyl, acyl substituted benzyl, amino substituted benzyl, amido substituted benzyl, arylalkyl substituted benzyl, aryl substituted benzyl, alkoxy alkyl substituted benzyl, aryloxy alkyl substituted benzyl, amino alkyl substituted benzyl, hydroxy alkyl substituted benzyl, alkyl amino substituted benzyl, aryl amino substituted benzyl, alkyl carbonyl substituted benzyl, alkyl thio substituted benzyl, alkyl seleno substituted benzyl, carboxamido substituted benzyl, halogen substituted benzyl, carboxyl substituted benzyl, cyano substituted benzyl, and nitro substituted benzyl; and $n$ is 1 to 4;

b. forming a latent electrostatic image on the surface of said insulating film;

c. developing the latent image by bringing said latent image in contact with oppositely charged developer materials;

d. affixing of the developer materials to the insulating polymeric film; and e. heating the insulating film to a temperature in a range sufficient to cuase substantial depletion of selenium particles from the insulating polymer matrix.

* * * * *

UNITED STATES PATENT AND TRADEMARK OFFICE

CERTIFICATE OF CORRECTION

PATENT NO. : 4,047,947

DATED : September 13, 1977

INVENTOR(S) : Joseph Y. C. Chu and Wolfgang H. H. Gunther

It is certified that error appears in the above-identified patent and that said Letters Patent are hereby corrected as shown below:

1. Column 1, line 9, "aritcle" should be --article--.
2. Column 1, line 46, "solent" should be --solvent--.
3. Column 2, line 8, "imagining" should be --imaging--.
4. Column 2, line 16, "cakes" should be --takes--.
5. Column 2, line 27, "thuscan" should be --thus can--.
6. Column 2, line 63, "it" should be --It--.
7. Column 3, line 29, "substitued" should be --substituted--.
8. Column 5, line 36, "th" should be --the--.
9. Column 5, line 51, "latitutde" should be --latitude--.
10. Column 7, line 46, "imagining" should be --imaging--.
11. Column 9, line 46, "contaning" should be --containing--.
12. Column 11, line 33, "photochemcial" should be --photochemical--.
13. Column 12, line 34 (Claim 5), "comprises" should be --comprise--.
14. Column 14, line 19 (Claim 15), "cuase" should be --cause--.

Signed and Sealed this

*Fourteenth* Day of *February 1978*

[SEAL]

*Attest:*

RUTH C. MASON
*Attesting Officer*

LUTRELLE F. PARKER
*Acting Commissioner of Patents and Trademarks*